US011007543B2

(12) United States Patent
Wang et al.

(10) Patent No.: US 11,007,543 B2
(45) Date of Patent: May 18, 2021

(54) SHOWER HEAD WITH INNER CORE

(71) Applicants: Xiamen Lota International Co., Ltd., Fujian (CN); Lota Xiamen Industry Co., Ltd., Fujian (CN)

(72) Inventors: Xuedong Wang, Xiamen (CN); Jiangcheng Zhang, Xiamen (CN); Xiaofei Guo, Xiamen (CN)

(73) Assignees: XIAMEN LOTA INTERNATIONAL CO., LTD., Fujian (CN); LOTA XIAMEN INDUSTRY CO., LTD., Fujian (CN)

( * ) Notice: Subject to any disclaimer, the term of this patent is extended or adjusted under 35 U.S.C. 154(b) by 220 days.

(21) Appl. No.: 16/026,060

(22) Filed: Jul. 3, 2018

(65) Prior Publication Data

US 2019/0336987 A1 Nov. 7, 2019

(30) Foreign Application Priority Data

May 3, 2018 (CN) ..... 201810415335.8

(51) Int. Cl.
*B05B 1/18* (2006.01)
*B05B 1/30* (2006.01)

(52) U.S. Cl.
CPC ..... *B05B 1/185* (2013.01); *B05B 1/3013* (2013.01)

(58) Field of Classification Search
CPC ..... B05B 1/18; B05B 1/185; B05B 1/3013; B05B 15/40; B05B 7/2462; B05B 7/04; B05B 1/3026; B05B 1/3033
USPC ..... 239/569–586
See application file for complete search history.

(56) References Cited

U.S. PATENT DOCUMENTS 5,624,073 A * 4/1997 Mueller ..... B05B 1/1663 239/442
2016/0236118 A1* 8/2016 Sharratt ..... B05B 15/40

* cited by examiner

*Primary Examiner* — Tuongminh N Pham
*Assistant Examiner* — Juan C Barrera
(74) *Attorney, Agent, or Firm* — Leong C. Lei

(57) ABSTRACT

A shower head with an inner core includes a shower head body, an inlet valve core assembly, an inner core assembly, and a water outlet panel. The inlet valve core assembly is fitted in an inlet valve chamber of the shower head body. A return spring of the inlet valve core assembly abuts against an inner wall of the inlet valve chamber and one end of an inlet valve core. The inner core assembly is detachably fitted inside an inner core chamber. The water outlet panel is connected with the shower head body and provided with a functional water chamber communicating with a water outlet passage. The shower head can prevent the inner core assembly from flying out of the inner core chamber due to the impact of the water flow to hurt the user.

8 Claims, 6 Drawing Sheets

SHOWER HEAD WITH INNER CORE

BACKGROUND OF THE INVENTION

1. Field of the Invention

The present invention relates to a bathroom accessory, and more particularly to a shower head with an inner core.

2. Description of the Prior Art

In a conventional shower head with an inner core, the inner core of an inner core assembly may be a filter core or an essence or a lotion. The conventional shower head with an inner core generally has its inner core assembly directly installed in the inlet waterway of the shower head. In order to facilitate the replacement of the inner core assembly, the inner core assembly is detachably installed in the inlet waterway. This installation structure has a problem that when the shower head is in a spray state, in the case of accidental detachment of the inner core assembly or disassembly of the inner core assembly, the inner core assembly will fly out quickly by the impact of the water flow with large pressure in the inlet waterway. The inner core assembly may hurt the user and is very unsafe for use.

Accordingly, the inventor of the present invention has devoted himself based on his many years of practical experiences to solve these problems.

SUMMARY OF THE INVENTION

The primary object of the present invention is to provide a shower head with an inner core, which can prevent an inner core assembly from flying out of an inner core chamber due to the impact of the water flow to hurt the user.

In order to achieve the above object, the shower head of the present invention comprises a shower head body, an inlet valve core assembly, an inner core assembly, and a water outlet panel. The shower head body is provided with a water inlet passage, an inlet valve chamber, an inner core chamber, and a water outlet passage. The inlet valve chamber has a water inlet communicating with the water inlet passage and a water outlet communicating with the inner core chamber. The inner core chamber has an opening communicating with the water outlet passage. The inlet valve core assembly is fitted in the inlet valve chamber. The inlet valve core assembly includes a return spring and an inlet valve core for controlling whether the water inlet passage communicates with the inner core chamber by moving. Two ends of the return spring abut against an inner wall of the inlet valve chamber and one end of the inlet valve core, respectively. The inner core assembly is detachably fitted inside the inner core chamber and abuts against another end of the inlet valve core so that the water inlet passage communicates with the inner core chamber. The inner core assembly has an inlet communicating with the water inlet and an outlet communicating with the water outlet passage. The water outlet panel is connected with the shower head body and provided with a functional water chamber communicating with the water outlet passage.

Preferably, the inlet valve core is a hollow valve shaft that is movably fitted in the water outlet. One end of the hollow valve shaft is formed with an annular retaining edge that is located in the inlet valve chamber and abuts against a periphery of the water outlet. The two ends of the return spring abut against the annular retaining edge and the inner wall of the inlet valve chamber, respectively. The hollow valve shaft is internally provided with a water channel communicating with the inner core chamber. A side wall of the hollow valve shaft is provided with a water hole communicating with the water channel. The inner core assembly abuts against another end of the hollow valve shaft.

Preferably, when the annular retaining edge abuts against the periphery of the water outlet, a pressure relief gap communicating with the water hole is formed between the annular retaining edge and the periphery of the water outlet.

Preferably, the water outlet of the inlet valve chamber faces the inlet of the inner core assembly. The other end of the hollow valve shaft is movably inserted in the inlet.

Alternatively, the inlet valve core includes a valve rod movably inserted into the water outlet and a gasket fixed on the valve rod. The gasket is located in the inner valve chamber and moveably blocks the water outlet. The two ends of the return spring abut against the inner wall of the inlet valve chamber and the gasket, respectively. The inner core assembly abuts against an outer end of the valve rod. The outer end of the valve rod is located outside the inlet valve chamber.

Preferably, a bottom of the inlet valve chamber is provided with the water outlet. One side of the inlet valve chamber is provided with the water inlet. A top of the inlet valve chamber is provided with a through hole communicating with the water outlet passage. The gasket movably blocks the water outlet and the through hole. A check valve is fitted in the opening communicating with the water outlet passage of the inner core chamber.

Preferably, the water outlet of the inlet valve chamber faces the inlet of the inner core assembly. The outer end of the valve rod, disposed outside the inlet valve chamber, is movably inserted in the inlet.

Preferably, one side of the inner core chamber is formed with a mounting opening through which the inner core assembly passes. An inner wall of the inner core chamber is provided with an engaging block. An outer wall of the inner core assembly is provided with a buckle block that is movably engaged with the engaging block.

Preferably, a fixing spring is provided between the inner core chamber and the inner core assembly. Two ends of the fixing spring abut against the inner core assembly and another side of the inner core chamber opposite to the mounting opening, respectively.

Preferably, the inner core assembly includes an inner core, an inner core casing, and an inner core cover. The inner core casing has an accommodating chamber for accommodating the inner core. The inner core casing is provided with the inlet and the outlet. The inlet and the outlet communicate with the accommodating chamber, respectively. One side of the accommodating chamber defines a fixing hole. The inner core cover is detachably mounted on the fixing hole.

Preferably, the inner core is a filter core or an essence or a lotion.

Preferably, the shower head further comprises a housing that covers the shower head body.

When the shower head with an inner core of the present invention is mounted with the inner core assembly, the inner core assembly abuts against the inlet valve core so that the inlet valve core moves forward. Therefore, the water inlet passage communicates with the inner core chamber, and the return spring is compressed. The water in the water inlet passage can flow through the inner core assembly and enter the water outlet passage, and finally the water can be discharged through the water outlet panel. When the water enters the water inlet passage, if the inner core assembly is disassembled or the inner core assembly accidentally falls off, the inner core assembly is disengaged from the inner core chamber. At this time, the inner core assembly no longer abuts against the inlet valve core. Under the action of the return spring, the inlet valve core moves in reverse and is returned, so that the water inlet passage does not communicate with the inner core chamber. In this way, the water flow in the water inlet passage will not strongly impact the inner core assembly and cause the inner core assembly to fly out quickly, thereby preventing the inner core assembly from flying out and damaging the user.

DETAILED DESCRIPTION OF THE PREFERRED EMBODIMENTS

Embodiments of the present invention will now be described, by way of example only, with reference to the accompanying drawings.

First Embodiment

Figure 1:
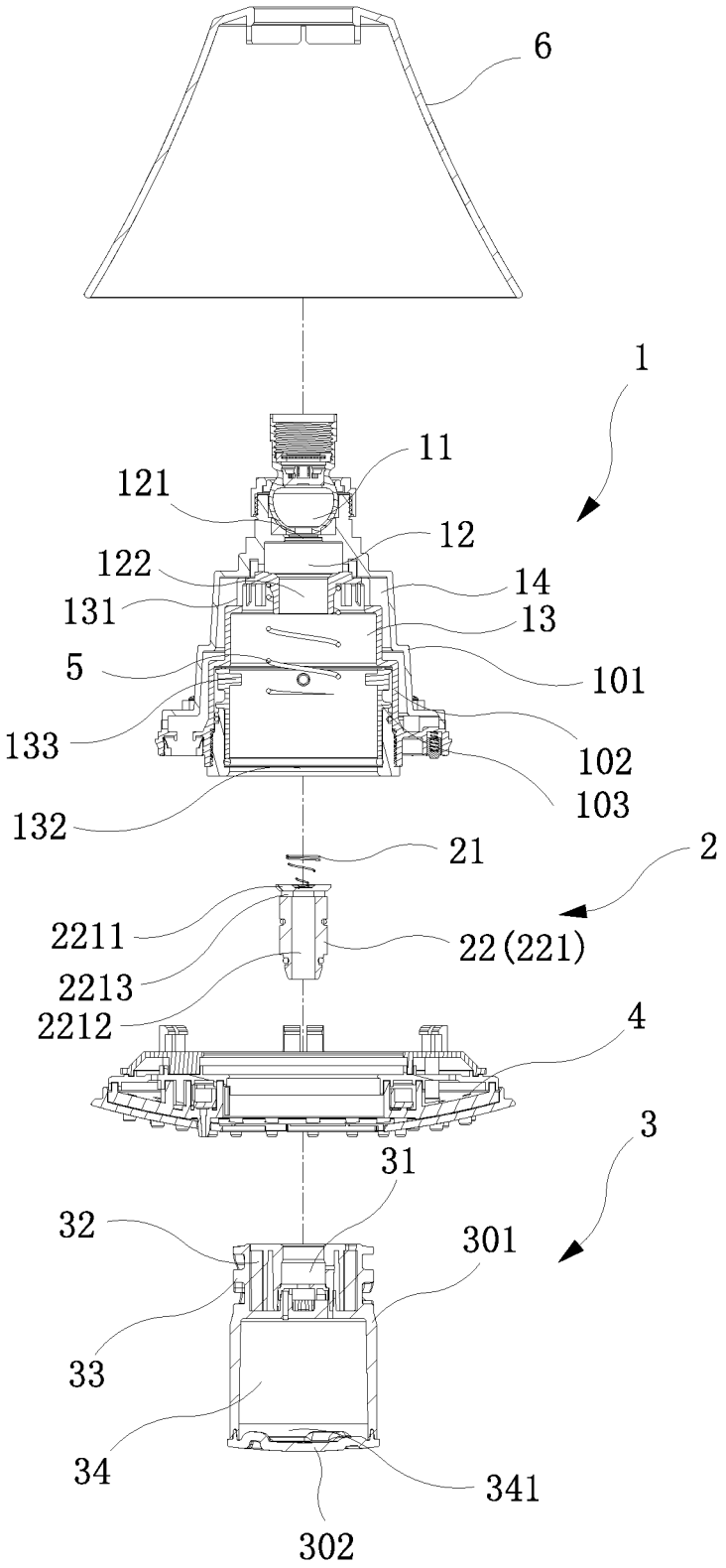
FIG. 1 is an exploded sectional view in accordance with a first embodiment of the present invention.
Figure 2:
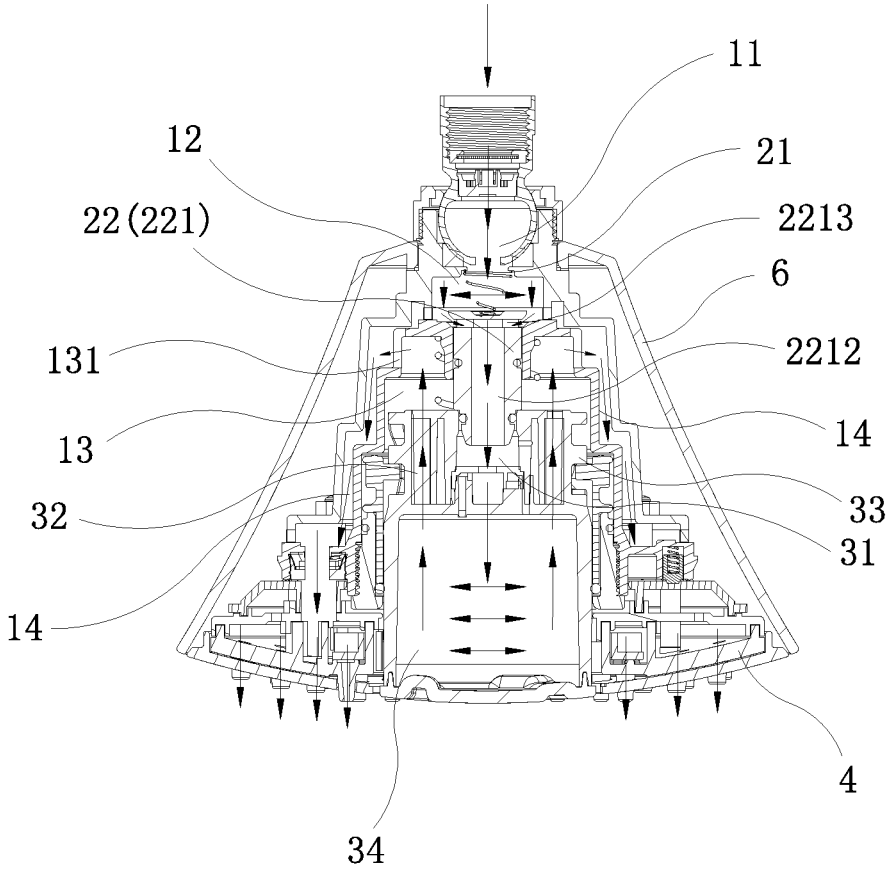
FIG. 2 is an assembled sectional view in accordance with the first embodiment of the present invention.
Figure 3:
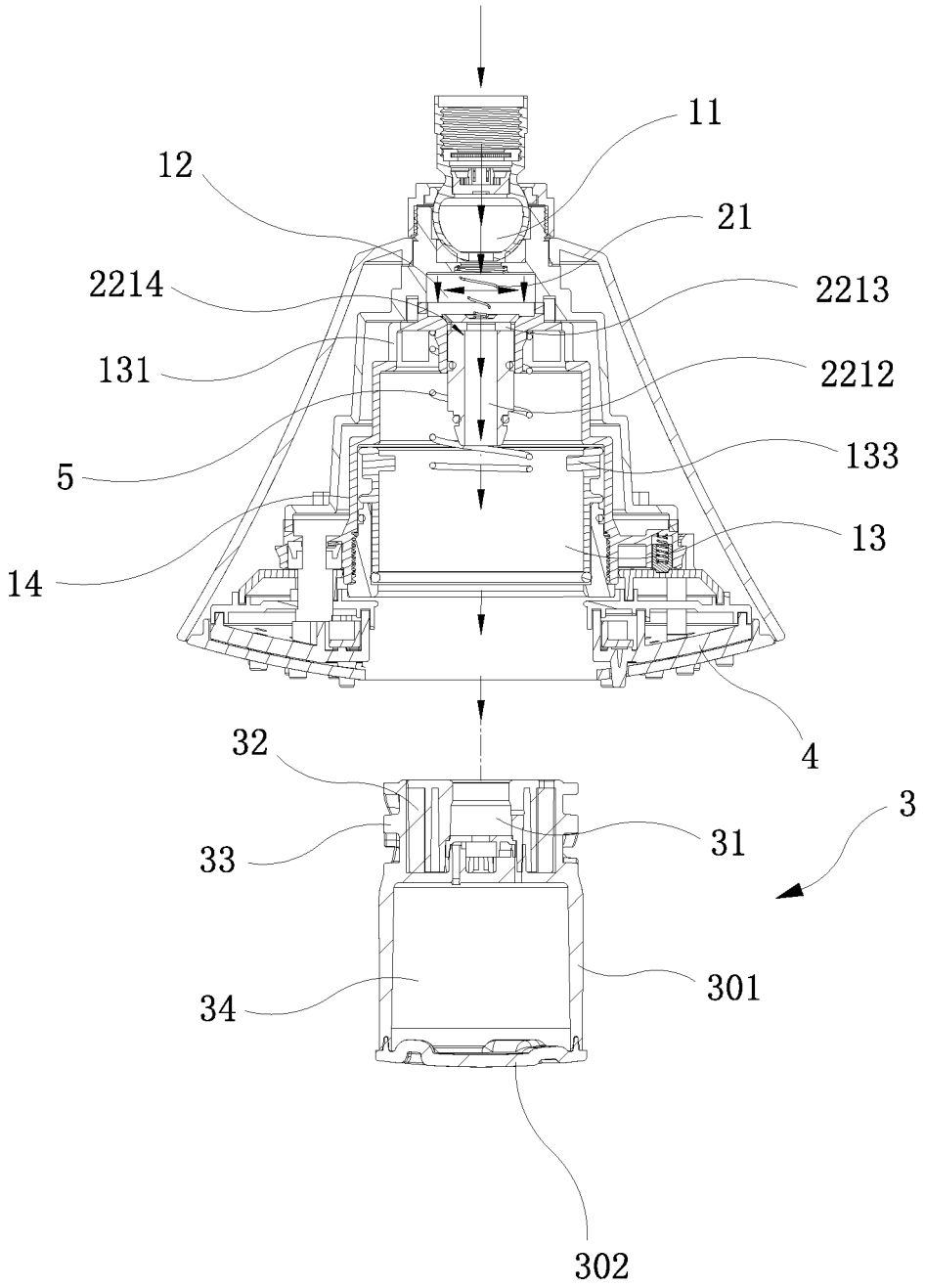
FIG. 3 is a partial sectional view in accordance with the first embodiment of the present invention (the inner core assembly is disengaged from the inner core chamber)

With reference to FIG. 1 to FIG. 3, the present embodiment discloses a shower head with an inner core. The shower head with an inner core comprises a shower head body 1, an inlet valve core assembly 2, an inner core assembly 3, and a water outlet panel 4. The shower head body 1 is provided with a water inlet passage 11, an inlet valve chamber 12, an inner core chamber 13, and a water outlet passage 14. The inlet valve chamber 12 has a water inlet 121 communicating with the water inlet passage 11 and a water outlet 122 communicating with the inner core chamber 13. The inner core chamber 13 has an opening 131 communicating with the water outlet passage 14. The inlet valve core assembly 2 is fitted in the inlet valve chamber 12. The inlet valve core assembly 2 includes a return spring 21 and an inlet valve core 22 for controlling whether the water inlet passage 11 communicates with the inner core chamber 13 by moving. Two ends of the return spring 21 abut against an inner wall of the inlet valve chamber 12 and one end of the inlet valve core 22, respectively. The inner core assembly 3 is detachably fitted inside the inner core chamber 13 and abuts against another end of the inlet valve core 22 so that the water inlet passage 11 communicates with the water outlet passage 14. The inner core assembly 3 has an inlet 31 communicating with the water inlet 122 and an outlet 32 communicating with the water outlet passage 14. The water outlet panel 4 is connected with the shower head body 1 and provided with a functional water chamber communicating with the water outlet passage 14. The water outlet panel 4 may be provided with only one functional water chamber, enabling the shower head with an inner core to provide one spray mode. The water outlet panel 4 may be provided with at least two functional water chambers, enabling the shower head with an inner core to provide multiple spray modes.

Specifically, in this embodiment, the inlet valve core 22 is a hollow valve shaft 221 that is movably fitted in the water outlet 122. One end of the hollow valve shaft 221 is formed with an annular retaining edge 2211 that is located in the inlet valve chamber 12 and abuts against the periphery of the water outlet 122. The two ends of the return spring 21 abut against the annular retaining edge 2211 and the inner wall of the inlet valve chamber 12, respectively. The hollow valve shaft 221 is internally provided with a water channel 2212 communicating with the inner core chamber 13. The side wall of the hollow valve shaft 221 is provided with a water hole 2213 communicating with the water channel 2212. The inner core assembly 3 abuts against another end of the hollow valve shaft 221. The water outlet 122 of the inlet valve chamber 12 faces the inlet 31 of the inner core assembly 3. The other end of the hollow valve shaft 221 is movably inserted in the inlet 31. This guides the movement of the hollow valve shaft 221 through the inlet 31.

In this embodiment, one side of the inner core chamber 13 is formed with a mounting opening 132 through which the inner core assembly 3 passes. The inner wall of the inner core chamber 13 may be provided with an engaging block 133. The inner core assembly 3 is provided with a buckle block 33 that is movably engaged with the engaging block 133 so that the inner core assembly 3 is detachably fitted in the inner core chamber 13. In order to strengthen the stability of the inner core assembly 3 to be fixed in the inner core chamber 13, a fixing spring 5 is provided between the inner core chamber 13 and the inner core assembly 3. Two ends of the fixing spring 5 abut against the inner core assembly 3 and the other side of the inner core chamber 13 opposite to the mounting opening 132 respectively, so that the buckle block 33 stably buckles the engaging block 133. The inner core assembly 3 is not limited to be detachably fitted in the inner core chamber 13 through the cooperation of the engaging block 133 and the buckle block 33. The inner core assembly 3 may be detachably fitted in the inner core chamber 13 through a screw thread connection.

In this embodiment, the inner core assembly 3 may include an inner core (not shown), an inner core casing 301, and an inner core cover 302. The inner core may be a filter core or an essence or a lotion. The inner core casing 301 has an accommodating chamber 34 for accommodating the inner core. The inner core casing 301 is provided with the inlet 31 and the outlet 32. The buckle block 33 may be disposed on the inner core casing 301. The inlet 31 and the outlet 32 communicate with the accommodating chamber 34, respectively. One side of the accommodating chamber 34 defines a fixing hole 341. The inner core cover 302 is detachably mounted on the fixing hole 341 through a snap connection, so that the inner core can be directly replaced or added by removing the inner core cover 302.

In order to understand this embodiment, the following describes the working principle of this embodiment in detail.

With reference to FIG. 2, when the inner core assembly 3 is mounted to the shower head with an inner core described in this embodiment, the inner core assembly 3 abuts against the hollow valve shaft 221 so that the hollow valve shaft 221 moves forward. Therefore, the annular retaining edge 2211 of the hollow valve shaft 221 does not abut against the periphery of the water outlet 122 and compresses the return spring 21. Through the water hole 2213 and the water channel 2212, the water inlet passage 11 communicates with the inner core chamber 13. The water in the water inlet passage 11 can flow through the inner core assembly 3 and enter the water outlet passage 14, and finally the water can be discharged through the water outlet panel 4. As shown in FIG. 3, when the water enters the water inlet passage 11, if the inner core assembly 3 is disassembled or the inner core assembly 3 accidentally falls off, the inner core assembly 3 is disengaged from the inner core chamber 13. At this time, the inner core assembly 3 no longer abuts against the hollow valve shaft 221. Under the action of the return spring 21, the hollow valve shaft 221 moves in reverse and is returned. The annular retaining edge 2211 of the hollow valve shaft 221 abuts against the periphery of the water outlet 122, so that the water inlet passage 11 does not communicate with the inner core chamber 13. In this way, the water flow in the water inlet passage 11 will not strongly impact the inner core assembly 3 and cause the inner core assembly 3 to fly out quickly, thereby preventing the inner core assembly 3 from flying out and damaging the user.

Furthermore, in this embodiment, when the annular retaining edge 2211 abuts against the periphery of the water outlet 122, a pressure relief gap 2214 communicating with the water hole 2213 is formed between the annular retaining edge 2211 and the periphery of the water outlet 122. The pressure relief gap 2214 can depressurize the water inlet passage 11 so that the force required to install the inner core assembly 3 can be reduced.

Furthermore, in this embodiment, the shower head with an inner core further comprises a housing 6 that covers the shower head body 1. The shower head body 1 is shielded by the housing 6 to improve the overall appearance.

It should be noted that in this embodiment, there are various specific structures of the shower head body 1. The specific structure of the shower head body 1 according to the waterway structure described in this embodiment is a conventional design. In order to understand this embodiment, a shower head body 1 is provided in this embodiment. Specifically, in this embodiment, the shower head body 1 includes a fixing seat 101, a connecting seat 102, and a fixing frame 103. The water inlet passage 11 is formed in the fixing seat 101. The connecting seat 102 is fitted in the fixing seat 101. The inner core chamber 13 is formed in the connecting seat 101. The inlet valve chamber 12 and the water outlet passage 14 are formed between the connecting seat 102 and the fixing seat 101. The fixing frame 103 is fitted in the inner core chamber 13 and formed with the engaging block 133. The fixing seat 101, the connecting seat 102 and the fixing frame 103 can be engaged with each other by snapping.

Second Embodiment

Figure 4:
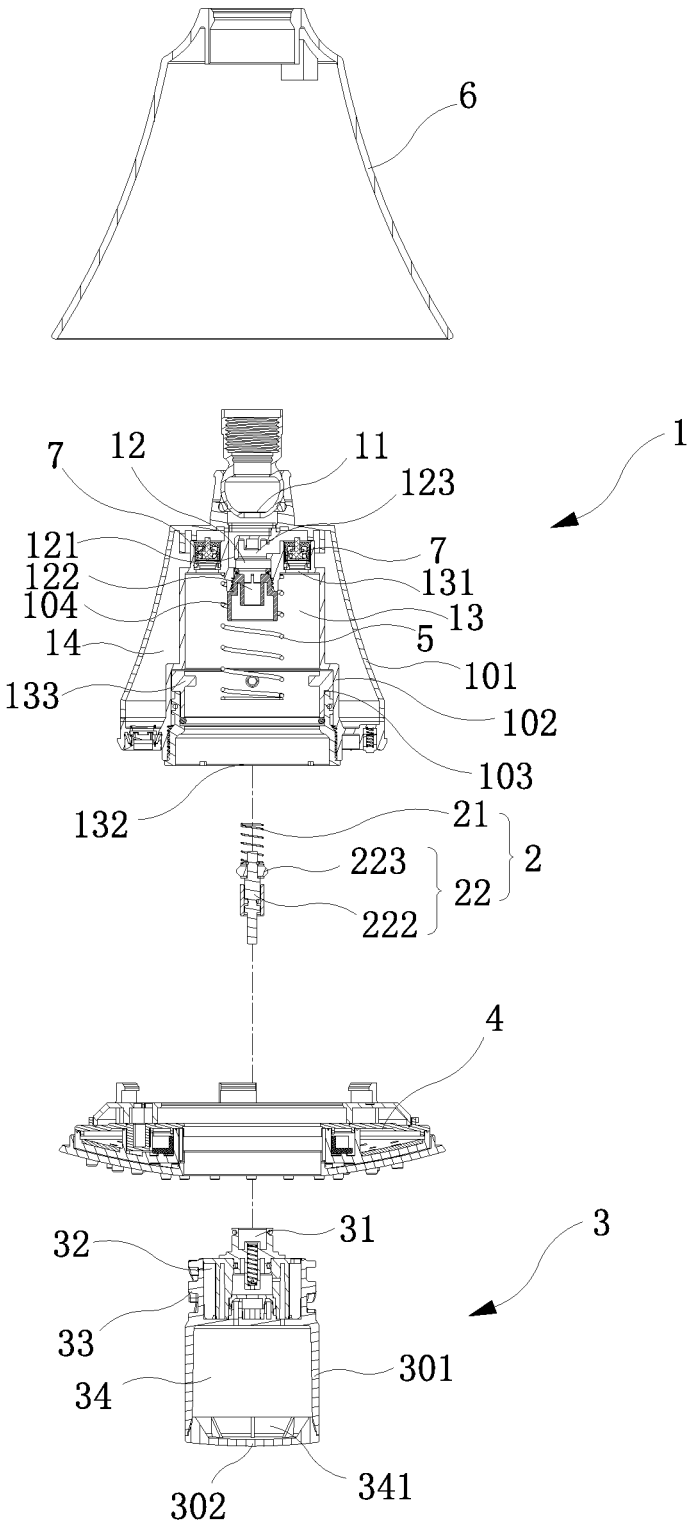
FIG. 4 is an exploded sectional view in accordance with a second embodiment of the present invention.
Figure 5:
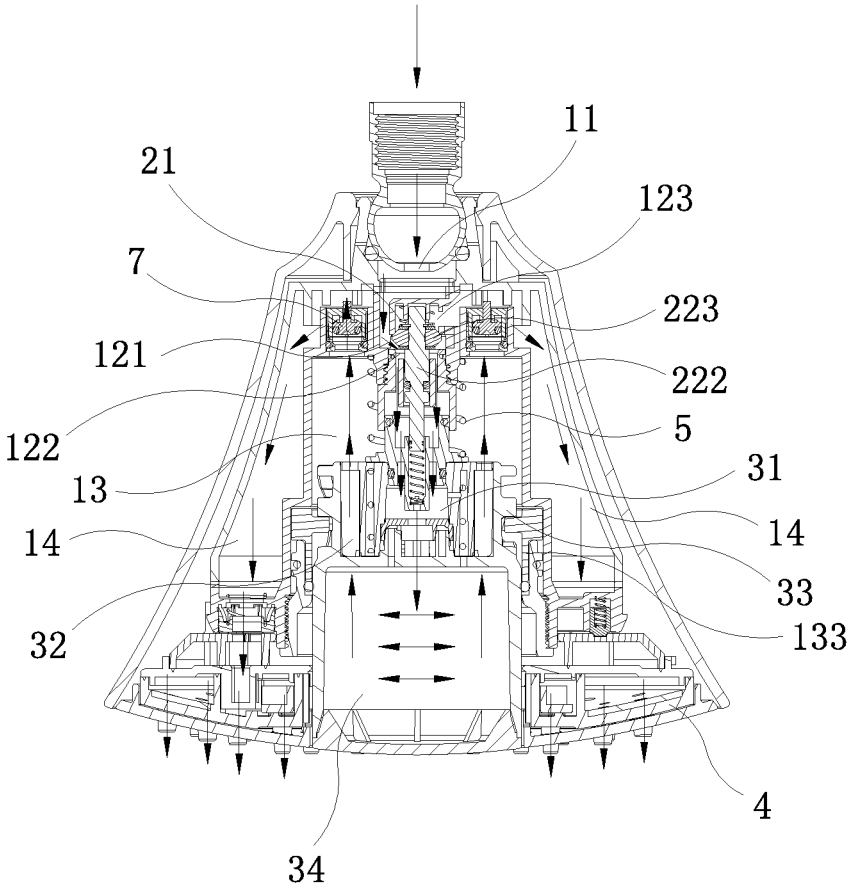
FIG. 5 is an assembled sectional view in accordance with the second embodiment of the present invention.
Figure 6:
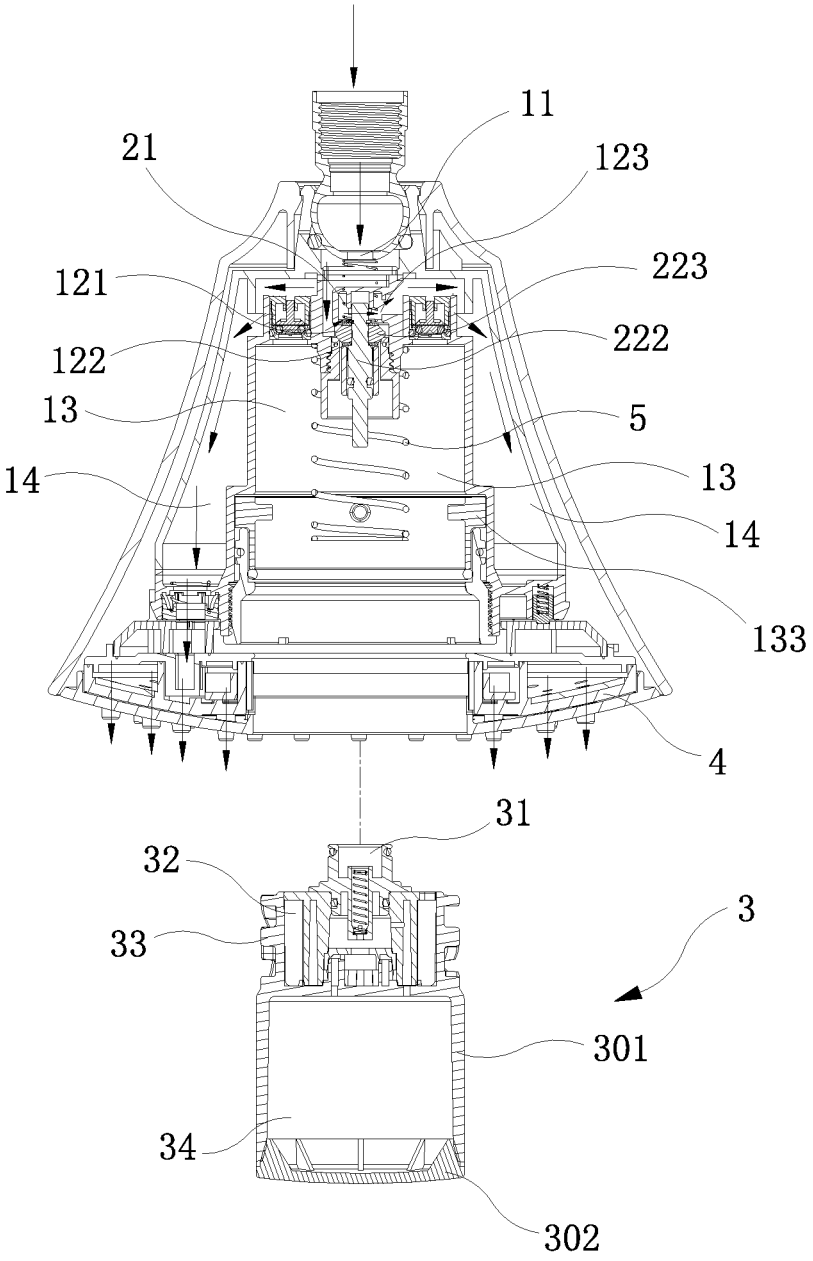
FIG. 6 is a partial sectional view in accordance with the second embodiment of the present invention (the inner core assembly is disengaged from the inner core chamber).

With reference to FIG. 4 to FIG. 6, the present embodiment discloses a shower head with an inner core. The shower head with an inner core comprises a shower head body 1, an inlet valve core assembly 2, an inner core assembly 3, and a water outlet panel 4. The shower head body 1 is provided with a water inlet passage 11, an inlet valve chamber 12, an inner core chamber 13, and a water outlet passage 14. The inlet valve chamber 12 has a water inlet 121 communicating with the water inlet passage 11 and a water outlet 122 communicating with the inner core chamber 13. The inner core chamber 13 has an opening 131 communicating with the water outlet passage 14. The inlet valve core assembly 2 is fitted in the inlet valve chamber 12. The inlet valve core assembly 2 includes a return spring 21 and an inlet valve core 22 for controlling whether the water inlet passage 11 communicates with the inner core chamber 13 by moving. Two ends of the return spring 21 abut against an inner wall of the inlet valve chamber 12 and one end of the inlet valve core 22, respectively. The inner core assembly 3 is detachably fitted inside the inner core chamber 13 and abuts against another end of the inlet valve core 22 so that the water inlet passage 11 communicates with the water outlet passage 14. The inner core assembly 3 has an inlet 31 communicating with the water inlet 122 and an outlet 32 communicating with the water outlet passage 14. The water outlet panel 4 is connected with the shower head body 1 and provided with a functional water chamber communicating with the water outlet passage 14. The water outlet panel 4 may be provided with only one functional water chamber, enabling the shower head with an inner core to provide one spray mode. The water outlet panel 4 may be provided with at least two functional water chambers, enabling the shower head with an inner core to provide multiple spray modes.

Specifically, in this embodiment, the inlet valve core 22 includes a valve rod 222 movably inserted into the water outlet 122 and a gasket 223 fixed on the valve rod 222. The gasket 223 is located in the inner valve chamber 12 and moveably blocks the water outlet 122. The two ends of the return spring 21 abut against the inner wall of the inlet valve chamber 12 and the gasket 223, respectively. The inner core assembly 3 abuts against an outer end of the valve rod 222. The outer end of the valve rod 222 is located outside the inlet valve chamber 12. The water outlet 122 of the inlet valve chamber 12 faces the inlet 31 of the inner core assembly 3. The outer end of the valve rod 222, disposed outside the inlet valve chamber 12, is movably inserted in the inlet 31. This guides the movement of the valve rod 222 through the inlet 31.

In this embodiment, one side of the inner core chamber 13 is formed with a mounting opening 132 through which the inner core assembly 3 passes. The inner wall of the inner core chamber 13 may be provided with an engaging block 133. The inner core assembly 3 is provided with a buckle block 33 that is movably engaged with the engaging block 133 so that the inner core assembly 3 is detachably fitted in the inner core chamber 13. In order to strengthen the stability of the inner core assembly 3 to be fixed in the inner core chamber 13, a fixing spring 5 is provided between the inner core chamber 13 and the inner core assembly 3. Two ends of the fixing spring 5 abut against the inner core assembly 3 and the other side of the inner core chamber 13 opposite to the mounting opening 132 respectively, so that the buckle block 33 stably buckles the engaging block 133. The inner core assembly 3 is not limited to be detachably fitted in the inner core chamber 13 through the cooperation of the engaging block 133 and the buckle block 33. The inner core assembly 3 may be detachably fitted in the inner core chamber 13 through a screw thread connection.

In this embodiment, the inner core assembly 3 may include an inner core (not shown), an inner core casing 301, and an inner core cover 302. The inner core may be a filter core or an essence or a lotion. The inner core casing 301 has an accommodating chamber 34 for accommodating the inner core, the inlet 31, and the outlet 32. The buckle block 33 may be disposed on the inner core casing 301. The inlet 31 and the outlet 32 communicate with the accommodating chamber 34, respectively. One side of the accommodating chamber 34 defines a fixing hole 341. The inner core cover 302 is detachably mounted on the fixing hole 341 through a snap connection, so that the inner core can be directly replaced or added by removing the inner core cover 302.

In this embodiment, when the inner core assembly 3 is detached from the inner core chamber 13, the water in the water inlet passage 11 still can flow into the water outlet passage 14, so as to ensure the water discharge of the shower head. The bottom of the inlet valve chamber 12 is provided with the water outlet 122. The side of the inlet valve chamber 12 is provided with the water inlet 121. The top of the inlet valve chamber 12 is provided with a through hole 123 communicating with the water outlet passage 14. The gasket 223 movably blocks the water outlet 122 and the through hole 123. A check valve 7 is fitted in the opening 131 communicating with the water outlet passage 14 of the inner core chamber 13.

In order to understand this embodiment, the following describes the working principle of this embodiment in detail.

With reference to FIG. 5, when the inner core assembly 3 is mounted to the shower head with an inner core, the inner core assembly 3 will abut against the valve rod 222, so that the return spring 21 is compressed and the gasket 223 is moved forward to block the through hole 123. At this time, the water outlet 122 is opened so that the water inlet passage 11 communicates with the inner core chamber 13. In this way, the water in the water inlet passage 11 can flow into the inner core assembly 3 and then pass through the check valve 7, and finally the water can be discharged through the water outlet panel 4. As shown in FIG. 6, when the water enters the water inlet passage 11, if the inner core assembly 3 is disassembled or the inner core assembly 3 accidentally falls off, the inner core assembly 3 is disengaged from the inner core chamber 13. At this time, the inner core assembly 3 no longer abuts against the valve rod 222. Under the action of the return spring 21, the valve rod 222 and the gasket 223 move in reverse and are returned. The gasket 223 blocks the water outlet 122, so that the water inlet passage 11 does not communicate with the inner core chamber 13. At the same time, the through hole 123 is opened, so that the water inlet passage 11 directly communicates with the water outlet passage 14 through the through hole 123. The water in the water inlet passage 11 directly flows into the water outlet passage 14 for discharging water. Due to the action of the check valve 7 in the opening 131, the water of the water outlet passage 14 does not flow into the inner core chamber 13. In this way, the water flow in the water inlet passage 11 will not strongly impact the inner core assembly 3 and cause the inner core assembly 3 to fly out quickly, thereby preventing the inner core assembly 3 from flying out and damaging the user. It can also ensure that when the inner core chamber 13 does not have the inner core assembly 3, the present invention can also normally discharge water.

Furthermore, in this embodiment, the shower head with an inner core further comprises a housing 6 that covers the shower head body 1. The shower head body 1 is shielded by the housing 6 to improve the overall appearance.

It should be noted that in this embodiment, there are various specific structures of the shower head body 1. The specific structure of the shower head body 1 according to the waterway structure described in this embodiment is a conventional design. In order to understand this embodiment, a shower head body 1 is provided in this embodiment. Specifically, in this embodiment, the shower head body 1 includes a fixing seat 101, a connecting seat 102, a fixing frame 103, and a valve body 104. The water inlet passage 11 is formed in the fixing seat 101. The connecting seat 102 is fitted in the fixing seat 101. The water outlet passage 14 is formed between the connecting seat 102 and the fixing seat 101. The upper half of the inlet valve chamber 12 and the inner core chamber 13 are formed in the connecting seat 101. The valve body 104 is fitted in the connecting seat 102 and provided with the lower half of the inlet valve chamber 12, so that the inlet valve chamber 12 is formed between the valve body 104 and the connecting seat 102. The fixing frame 103 is fitted in the inner core chamber 13 and formed with the engaging block 133. The fixing seat 101, the connecting seat 102, and the fixing frame 103 can be engaged with each other by snapping. The valve body 104 and the connecting seat 102 are connected by means of a screw thread connection.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower head, comprising a shower head body, an inlet valve core assembly, an inner core assembly and a water outlet panel;

the shower head body being provided with a water inlet passage, an inlet valve chamber, an inner core chamber and one single water outlet passage; the inlet valve chamber having a water inlet communicating with the water inlet passage and a water outlet communicating with the inner core chamber; the inner core chamber having an opening communicating with the water outlet passage;

the inlet valve core assembly being fitted in the inlet valve chamber; the inlet valve core assembly including a return spring and an inlet valve core that is movable between a first position to block fluid communication between the water inlet passage and the inner core chamber and a second position to enable fluid communication between the water inlet passage and the inner core chamber; two ends of the return spring abutting against an inner wall of the inlet valve chamber and one end of the inlet valve core respectively to bias the inlet valve core to the first position;

the inner core assembly being detachably fitted inside the inner core chamber and abutting against another end of the inlet valve core to cause the inlet valve core to move to the second position so that the water inlet passage communicates with the inner core chamber; the inner core assembly having an inlet communicating with the water inlet and an outlet communicating with the water outlet passage;

the water outlet panel being connected with the shower head body and provided with a functional water chamber communicating with the water outlet passage;

wherein the inlet valve core includes a valve rod movably inserted into the water outlet and a gasket fixed on the valve rod; the gasket is located in the inlet valve chamber and moveably blocks the water outlet, the two ends of the return spring abut against the inner wall of the inlet valve chamber and the gasket respectively, the inner core assembly abuts against an outer end of the valve rod, and the outer end of the valve rod is located outside the inlet valve chamber; and wherein in the first position, the inlet valve core blocks fluid communication between the water inlet passage and the inner core chamber so that water flows from the water inlet passage directly to the water outlet passage by bypassing the inner core assembly fitted inside the inner core chamber; and in the second position, the inlet valve core enables fluid communication between the water inlet passage and the inner core chamber so that water flows from the water inlet passage through the inner core assembly fitted inside the inner core chamber to the water outlet passage, and wherein water flows from the water inlet passage to the one single water outlet passage when the inlet valve core being set in either the first and second positions.

2. The shower head as claimed in claim 1, wherein a bottom of the inlet valve chamber is provided with the water outlet, one side of the inlet valve chamber is provided with the water inlet, a top of the inlet valve chamber is provided with a through hole communicating with the water outlet passage, the gasket movably blocks the water outlet and the through hole; and a check valve is fitted in the opening communicating with the water outlet passage of the inner core chamber.

3. The shower head as claimed in claim 1, wherein the water outlet of the inlet valve chamber faces the inlet of the inner core assembly, and the outer end of the valve rod, disposed outside the inlet valve chamber, is movably inserted in the inlet.

4. The shower head as claimed in claim 1, wherein one side of the inner core chamber is formed with a mounting opening through which the inner core assembly passes; an inner wall of the inner core chamber is provided with an engaging block; and an outer wall of the inner core assembly is provided with a buckle block that is movably engaged with the engaging block.

5. The shower head as claimed in claim 4, wherein a fixing spring is provided between the inner core chamber and the inner core assembly; and two ends of the fixing spring abut against the inner core assembly and another side of the inner core chamber opposite to the mounting opening respectively.

6. The shower head as claimed in claim 1, 4 or 5, wherein the inner core assembly includes an inner core, an inner core casing and an inner core cover; the inner core casing has an accommodating chamber for accommodating the inner core, the inner core casing is provided with the inlet and the outlet; the inlet and the outlet communicate with the accommodating chamber respectively; one side of the accommodating chamber defines a fixing hole, and the inner core cover is detachably mounted on the fixing hole.

7. The shower head as claimed in claim 6, wherein the inner core is a filter core or an essence or a lotion.

8. The shower head as claimed in claim 1, further comprising a housing that covers the shower head body.

* * * * *